United States Patent [19]

Boyd

[11] Patent Number: 4,876,521

[45] Date of Patent: Oct. 24, 1989

[54] TRIPPING COIL WITH FLUX SHIFTING COIL AND BOOSTER COIL

[75] Inventor: Donald R. Boyd, Sanford, N.C.

[73] Assignee: Siemens Energy & Automation, Inc., Atlanta, Ga.

[21] Appl. No.: 203,554

[22] Filed: May 31, 1988

Related U.S. Application Data

[63] Continuation of Ser. No. 89,298, Aug. 25, 1987, abandoned.

[51] Int. Cl.[4] ..... H01H 9/00

[52] U.S. Cl. ..... 335/179; 335/182

[58] Field of Search ..... 335/179–185, 335/126, 131

[56] References Cited

U.S. PATENT DOCUMENTS

| | | | |
|---|---|---|---|
| 2,536,740 | 1/1951 | Haddad | 335/178 |
| 2,759,062 | 8/1956 | O'Neill | 335/179 |
| 2,841,669 | 7/1958 | Cook | 335/178 |
| 2,916,584 | 12/1959 | Molyneux | 335/179 |
| 2,919,324 | 12/1959 | Schuessler | 335/179 |
| 3,022,450 | 2/1962 | Chase | 317/123 |
| 3,248,499 | 4/1966 | Young | 335/182 |
| 3,683,239 | 8/1972 | Sturman | 317/150 |
| 3,693,122 | 9/1972 | Willard | 335/174 |
| 3,783,423 | 1/1974 | Mater et al. | 335/174 |
| 3,792,390 | 2/1974 | Boyd | 335/229 |
| 3,886,507 | 5/1975 | Johnston et al. | 335/234 |
| 3,944,957 | 3/1976 | Kotos et al. | 335/174 |
| 4,013,926 | 3/1977 | Lang et al. | 361/115 |
| 4,078,219 | 3/1978 | Hodgson | 355/167 |
| 4,129,843 | 12/1978 | Keller et al. | 335/174 |
| 4,172,241 | 10/1979 | Bosch et al. | 335/174 |
| 4,213,109 | 7/1980 | Marcoz | 335/174 |
| 4,238,750 | 12/1980 | Smith | 335/173 |
| 4,251,789 | 2/1981 | Russel et al. | 335/174 |
| 4,370,637 | 1/1983 | Siffroi | 335/174 |
| 4,399,421 | 8/1983 | MacLean | 335/174 |
| 4,599,590 | 7/1986 | Preuss et al. | 335/175 |
| 4,641,117 | 2/1987 | Willard | 335/7 |
| 4,660,012 | 4/1987 | Bonniav et al. | 335/179 |

FOREIGN PATENT DOCUMENTS

| | | | |
|---|---|---|---|
| 0121963 | 10/1984 | European Pat. Off. . | |
| 0107167 | 1/1987 | European Pat. Off. . | |
| 1034251 | 7/1958 | Fed. Rep. of Germany . | |
| 1141013 | 4/1960 | Fed. Rep. of Germany . | |
| 526637 | 3/1953 | France | 335/177 |
| 906594 | 4/1960 | United Kingdom . | |
| 2122031 | 1/1984 | United Kingdom . | |

OTHER PUBLICATIONS

European Standard Search Report.

*Primary Examiner*—E. A. Goldberg
*Assistant Examiner*—Lincoln Donovan
*Attorney, Agent, or Firm*—James G. Morrow

[57] ABSTRACT

A tripping coil for a circuit breaker, wherein the circuit breaker is designed to carry high load currents. The tripping coil includes a coil having a first winding and a second winding, a permanent magnet, a return spring, an armature and an actuator rod. The first winding and the permanent magnet produce a magnetic flux to urge and hold the armature into a biased position. The second winding produces a magnetic flux which urges the armature into an unbiased position. The return spring also exerts a force on the armature urging the armature into the unbiased position. The actuator rod is fixed to the armature, and interacts with the circuit breaker such that the circuit breaker is tripped when the armature moves into the unbiased position.

8 Claims, 3 Drawing Sheets

TRIPPING COIL WITH FLUX SHIFTING COIL AND BOOSTER COIL

CROSS-REFERENCE TO RELATED APPLICATION

This is a continuation of Ser. No. 089,298 filed Aug. 25, 1987.

BACKGROUND OF THE INVENTION

1. Field of the Invention

This invention relates generally to a tripping device used in a circuit breaker and more particularly to a tripping device used in a circuit breaker designed to carry high load currents.

2. Description of the Prior Art

Tripping devices are essential to the operation of breakers. Typically, circuit breakers are held closed by a latch and are tripped open by a tripping device acting on a trigger to release the latch. In large circuit breakers and important installations a tripping coil actuated by a control means is used as a tripping device. Generally, a tripping coil includes an armature, an actuator rod, a return spring, a permanent magnet and a d.c. (direct current) coil having a single winding. The permanent magnet biases the armature and actuator rod against the return spring. When the control means energizes the d.c. coil, due to a current overload, the armature and actuator rod are pulled away from the permanent magnet and the actuator rod triggers the release of the latch, thereby causing the breaker to open.

One problem with the tripping coil described above is the spurious tripping of a circuit breaker caused by the magnetic field produced by a high alternating load current (e.g. 85,000 amperes) carried by the circuit breaker. Normally, the tripping coil for a circuit breaker is located in close proximatry to the load current in the circuit breaker. As the current of the alternating load current increases, the flux density in the space surrounding the load current conductors increases. When the load current becomes high enough, the spurious magnetic flux produced can pull the armature and actuating rod away from the permanent magnet, thereby tripping the circuit breaker.

One approach to this spurious tripping problem is the shielding of the d.c. coil in the tripping device from the magnetic flux produced by the load current. This approach has the drawbacks of increasing the size of the tripping coil and increasing its manufacturing cost . In addition, the use of shielding may be ineffective or impractical when the normal load currents in a circuit breaker are very high.

Another approach to this problem is to use either a stronger permanent magnetic or a weaker return spring. This has the drawback of requiring a higher tripping force and correspondingly requires a larger d.c. coil. The use of a larger d.c. coil increases the time it takes the tripping coil to trip the circuit breaker, requires a larger power supply for energizing the d.c. coil, and increases the cost and size of the tripping device.

SUMMARY OF THE INVENTION

The novel tripping coil in accordance with the present invention has an armature connected to an actuator rod such that the circuit breaker is tripped when the armature moves to the unbiased position. A coil unit, having a first winding, a second winding and a bobbin for containing the windings, is disposed around the armature.

The magnetic flux of a permanent magnet and the magnetic flux produced by the first winding, when energized, maintain the armature in a biased position. The magnetic flux produced by the first winding is not always required to hold the armature in the biased position. Thus, the first winding can be energized continuously or only when the magnetic fluxes produced by the load current or second winding are strong enough to urge the armature into the unbiased position.

To urge the armature into its unbiased position, the first winding is deenergized and the second winding is energized such that the magnetic flux produced by the second winding is opposed to the magnetic flux of the permanent magnet. In addition, a return spring also is used to urge the armature into the unbiased position. The first winding can also be energized such that it produces a magnetic flux opposed to that of the permanent magnet. The second winding can be used as a feedback device for the control means. The load current induces a secondary current in the second winding such that the secondary current is useful as feedback to the control means.

The windings are energized with a d.c. current by control means. The control means senses the load current such that the tripping coil trips the circuit breaker when the load current rises above the capacity of the circuit breaker.

Various other objects of the present invention will become apparent from the following description, with reference to the accompanying drawings.

BRIEF DESCRIPTION OF THE DRAWINGS

The preferred embodiment of the invention will be described with reference to the accompanying drawings wherein.

DETAILED DESCRIPTION OF THE PREFERRED EMBODIMENT OF THE INVENTION

Figure 1:
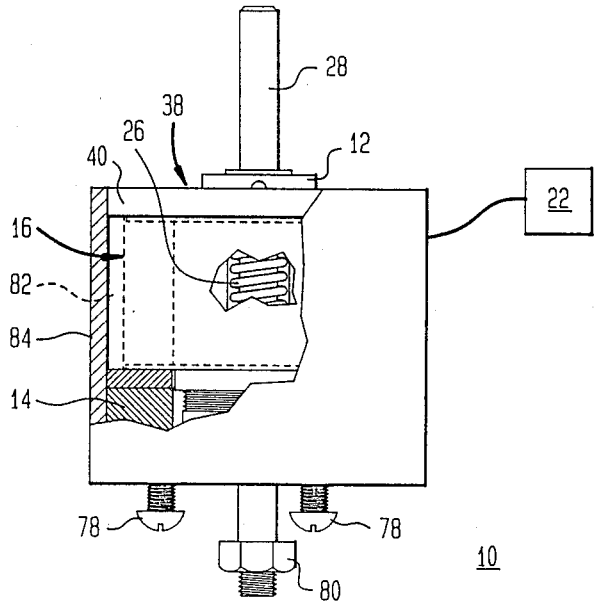
FIG. 1 a partially sectioned, partially exposed side view of a tripping device in accordance with a preferred embodiment of the invention having flux shifting coils.
Figure 2:
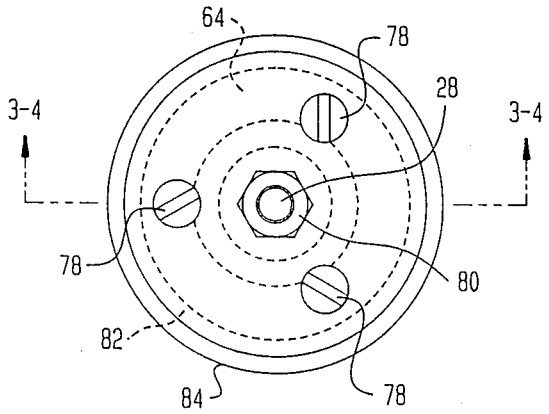
FIG. 2 is a bottom view of the tripping device.

The tripping coil 10 shown in FIGS. 1–5 of the drawings comprises an armature 12, a permanent magnet 14, a coil unit 16 with a first winding 18 and a second winding 20, means for guiding the armature, control means 22, means for connecting the armature to the circuit breaker, a bobbin 24, a return spring 26 and an actuator rod 28.

The armature 12 includes an opening 30 in which the actuator rod 28 is fixed. The actuator rod 28 is fixed within the opening 30 with a pin 32 which is pressed through the actuator rod 28 and the armature 12. The armature 12 also includes a bore 34 for laterally supporting the return spring 26 positioned within the bore 34. The return spring 26 exerts a force against the armature 12 at the shoulder 36 of the bore 34. This force urges the armature 12 and actuator rod 28 into an unbiased position.

The means for guiding the armature includes a pole top 38. The pole top 38 includes a shoulder plate 40, an inside bore 42 and an outside surface 44 having a threaded region 46. The inside bore 42 is sized such that the armature 12 can freely translate axially within the inside bore 42.

The windings 18, 20 are wound on a bobbin 24 which includes a first shoulder 52, a second shoulder 54 and a sleeve 56. The second winding 20 is wound onto the bobbin sleeve 56 first and separated from the first winding 18 by a sheet of insulating material 50. The first winding 18 is wound over the second winding 20.

The sleeve 56 includes a threaded region 58, adapted to accept the threaded region 46 of the pole top 38 and the threaded region 70 of a pole bottom 64. The second shoulder 54 of the bobbin 24 is fixed to the sleeve 56 such that a flange 60 is formed at one end of the bobbin 24. The flange 60 centers a washer 62 between the permanent magnet 14 and the second shoulder 54 of the bobbin 24.

Figure 4:
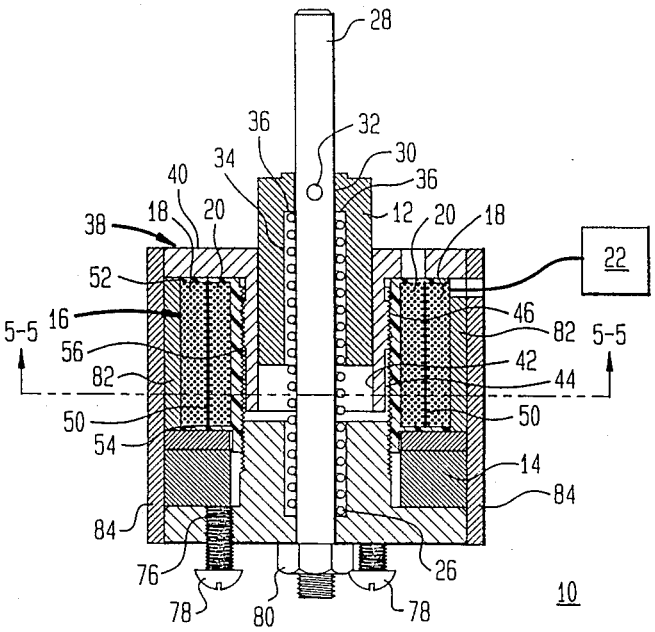
FIG. 4 is a sectional view of the device of FIG. 2 taken along line 3–4, where the tripping device is in the unbiased position.
Figure 5:
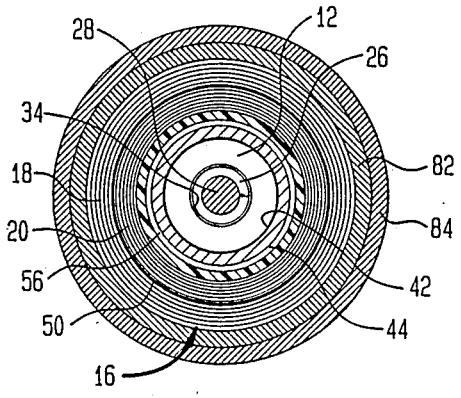
FIG. 5 is a sectional of the device of FIG. 4 view taken along line 5—5.

The pole bottom 64 guides the actuator rod 28, laterally supports the spring 26 and centers the permanent magnet 14. The pole bottom 64 includes a shoulder plate 66, and an outside surface 68 having a threaded region 70. The pole bottom 64 also includes a bore 72 designed to accept the return spring 26. The force exerted by the return spring 26, as a result of the force exerted against the armature 12, acts upon the bottom surface 74 of the bore 72. The shoulder plate 66 includes threaded holes 76 adapted to accept machine screws 78 for mounting the tripping coil 10 within a circuit breaker (not shown). As illustrated in FIG. 4, the shoulder plate 66 also serves as a stop for the stop nut 80 fixed to the actuator rod 28.

A first cylindrical shield 82 and second cylindrical shield 84 for shielding the coil unit 16 are illustrated in FIGS. 1–4. These serve to substantially shield the coil unit 16 from external magnetic fluxes and also serve to protect the components of the tripping coil from environmental effects.

To assemble the tripping coil 10, the bobbin 24, is fixed onto the pole top 38 via the threaded regions 46, 58 of the pole top 38 and bobbin 24. Subsequently, the cylindrical shield 82 is slid over shoulders 52, 54 of the bobbin 24 and the washer 62 is centered upon the flange 60 of the bobbin 24. The permanent magnet 14 is centered upon the pole bottom 64 on the pole bottom 64 is then fixed within the bobbin 24 via the threaded regions 70, 58 of the pole bottom 64 and bobbin 24. The cylinidrical shield 84 is then slid over the shoulder plates 40, 66 of the poles 38, 64 and fixed into place via attachment means (not shown). Finally, the armature 12 and actuator rod 28 are fixed together with the pin 32 and placed within the inside bore 42 of the pole top 42 after the return spring 26 has been placed within the bore 72 of the pole bottom 64. The armature is placed within the inside bore 42 such that the stop nut 80 can be fixed upon the actuator rod 28.

Figure 3:
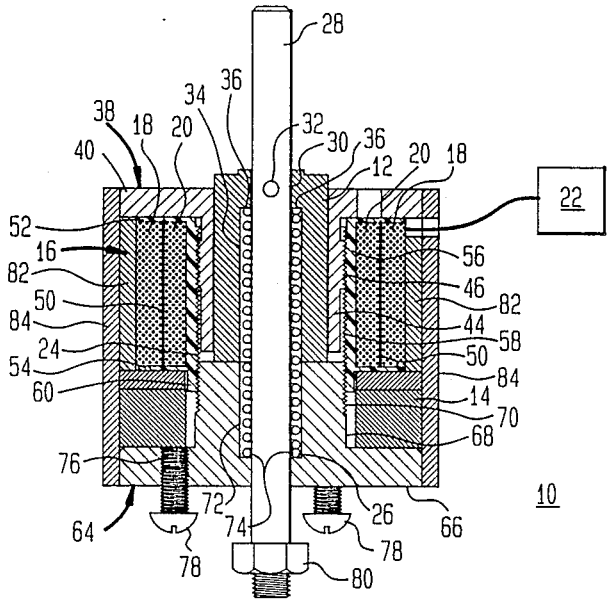
FIG. 3 is a sectional view of the device of FIG. 2 taken along line 3–4, wherein the tripping device is in the biased position.
Figure 6:
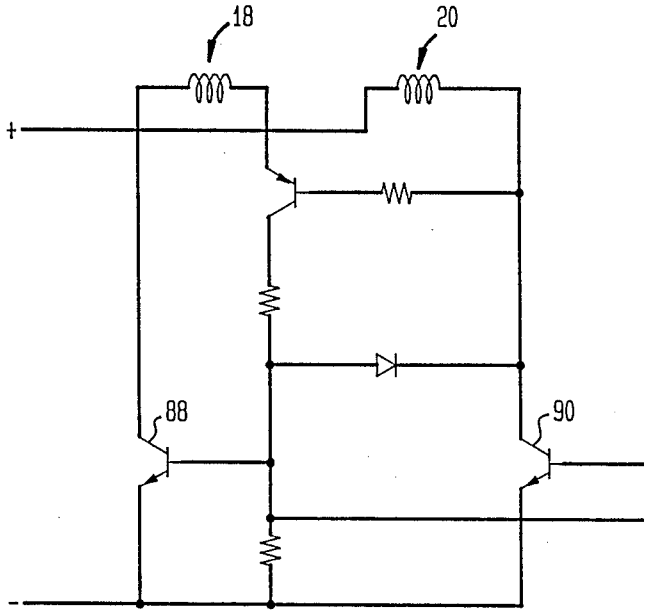
FIG. 6 is a schematic diagram of a control circuit for the device of FIGS. 1–5.

In FIGS. 3 and 4 a single line schematically illustrates the connection of the winding 18, 20 leads to the control means 22. By way of illustration, a control means such as a the circuit shown in FIG. 6 can be used to energize the windings 18, 20 and control the position (biased or unbiased) of the armature 12 for purposes of tripping a circuit breaker. When a signal is applied to the first transistor 88, the first winding 18 is energized. When a signal is applied to the second transistor 90, the second winding 20 is energized. (The winding 18, 20 are represented schematically in FIG. 6.)

OPERATION

The operation of the tripping coil 10 is best described with reference to FIGS. 3 and 4. FIG. 3 illustrates the armature 12 in a biased position, and FIG. 4 illustrates the armature 12 in an unbiased position.

The armature 12 and actuator rod 28 are urged into the biased position and held in the biased position by the magnetic flux of the permanent magnet 14 and the magnetic flux produced by the first winding 18 when energized. The first winding 18 can be referred to as a booster coil, since it boosts or adds to the magnetic flux produced by the permanent magnet 14. The magnetic flux produced by the first winding 18 is important, since it assists the permanent magnet 14 in holding the armature 12 in the biased position when an opposing magnetic flux is produced by the second winding 20 or the load current. The first winding 18 can be continuously energized, or only energized when the magnetic flux produced by the permanent magnet 14 is insufficient to hold the armature 12 in the biased position. An opposing magnetic flux is produced by the load current.

The cylindrical shields 82, 84 are designed to shield the second winding 20 from a portion of the magnetic flux produced by the load current. Due to cost and size constraints, however, these shields 82, 84 cannot be made to totally shield the second winding 20 from this flux. In addition, the permanent magnet 14 cannot be effectively made larger to overcome the opposing fluxes produced by the second winding 20 and load current, since a larger second winding 20 will then be needed to pull the armature 12 away from the permanent magnet 14 when the tripping coil 10 is required to trip the circuit breaker. Use of a larger second winding 20 is also problematic, since it will then take the control means a longer period of time to produce a magnetic flux in the second winding 20 sufficient to pull the armature 12 away form the permanent magnet 14. The time period for moving the armature 12 into its unbiased position to trip the circuit breaker is critical, Therefore, tripping coils need to react quickly to a signal requiring the circuit breaker to trip.

The armature 12 and actuator rod 28 are urged into the unbiased position when the first winding 18 is deenergized and the second winding 20 is energized. When energized, the second winding 20 acts as a flux shifting coil and produces a magnetic flux great enough to shift the magnetic flux in tripping coil 10 such that the armature 12 is urged away from the permanent magnet 14. In addition, the first winding 18 can be energized to produce a magnetic flux in substantially the same direction as that of the second winding 20. The return spring 26 also assists in urging the armature 12 into the unbiased position.

The second winding 20 also serves the function of producing feedback for the control means 22. The magnetic flux produced by the load current in the circuit breaker induces a current in the second winding 20. Since the current induced in the second winding 20 is a function of the load current, the control means 22 can monitor this current induced for purposes of prompting the tripping coil to trip the circuit breaker.

The dimensions and construction materials used in the tripping coil may be chosen for a particular application according to well know principles of engineering; however, in one embodiment of the tripping coil, the pole top 38 and armature 12 are manufactured from cold-rolled steel and plated with non-magnetic electroless nickelphosphorus. The pole bottom 64, washer 62 and coil shield 82, are manufactured from cold-rolled steel and plated with zinc. The permanent magnet 14 is manufactured from a ceramic. The bobbin 48 is manufactured from white nylon. For the coil unit 16, approximately 800 turns of insulated wire are used to form the second winding 20, and approximately 400 turns of insulated wire are used to form the first winding 18. The actuator rod 28 and shield 84 are manufactured from 6061-T6 aluminum alloy.

It should be understood that various changes and modifications to the preferred embodiment described herein will be apparent to those skilled in the art. For example, materials may be altered. Such changes and modifications can be made without departing from the scope of the present invention and without diminishing its attendant advantages. It is, therefore, intended that such changes and modifications be covered by the following claims.

I claim:

1. A tripping coil for tripping a circuit breaker, comprising:

a translatable armature;

a permanent magnet for biasing the armature;

a coil unit having a first winding and a second winding, wherein the first and second windings are mutually radially adjacent, each winding producing a magnetic flux when energized, the first winding being energizable such that it produces a magnetic flux which assists the magnetic flux of the permanent magnet in biasing the armature into a biased position, the second winding being energizable such that it produces a magnetic flux which opposes the magnetic flux of the permanent magnet urging the armature into an unbiased position when the first winding is not energized to produce a magnetic flux which assists the magnetic flux of the permanent magnet, the armature being translatable between the biased position and the unbiased position; and means for connecting the armature to the circuit breaker such that the circuit breaker is tripped when the armature moves to the unbiased position.

2. The tripping coil of claim 1, further comprising:

means for guiding the armature relative to the coil; and control means for energizing the first winding and the second winding.

3. The tripping coil of claim 2, wherein the coil includes a bobbin having an inside bore and a flange, the bobbin adapted to contain the windings.

4. The tripping coil of claim 3, further comprising:

a pole top including a shoulder plate, a sleeve having an inside bore adapted to accept the armature and an outside surface adapted to be engaged within the inside bore of the bobbin;

a pole bottom including a shoulder plate and an outside surface adpated to be fixed within the inside bore of the bobbin.

5. The tripping coil of claim 4, further comprising:

a return spring for urging the armature into the unbiased position, the pole bottom having a first inside bore adapted to accept the return spring.

6. The tripping coil of claim 5, wherein the means for connecting the armature to the circuit breaker comprises:

an actuator rod, the pole bottom having a second inside bore adapted to guide the actuator rod, and the armature having a second inside bore adapted to accept the actuator rod.

7. The tripping coil of claim 6 further comprising:

a washer for separating the bobbin and permanent magnet, wherein the washer rests on the flange of the bobbin;

means for fastening the actutator rod to the armature; and a cylindrical shield encompassing the coil.

8. A tripping coil for tripping a circuit breaker, comprising:

a translatable armature;

a permanent magnet for biasing the armature;

a coil unit having a first winding and a second winding, wherein the first and second windings are mutually radially adjacent, each winding producing a magnetic flux when energized, the coil including a bobbin for containing the windings and having an inside bore and a flange, the first winding being energized such that it produces a magnetic flux which assists the permanent magnet in biasing the armature into a biased position, the second winding being energized such that it produces a magnetic flux which opposes the magnetic flux of the permanent magnet urging the armature into an unbiased position when the first winding is not energized to produce a magnetic flux which assists the magnetic flux of the permanent magnet, the armature being translatable between the biased position and the unbiased position;

control means for energizing the first winding;

control means for energizing the second winding;

a return spring for urging the armature into the unbiased position;

an actuator rod for interacting with the circuit breaker such that the circuit breaker is tripped when the armature moves to the unbiased position;

a pole top including a shoulder plate, a sleeve having an inside bore adapted to accept and guide the armature and an outside surface adapted to be fixed within the inside bore of the bobbin;

a pole bottom including a shoulder plate, an outside surface adapted to be fixed within the inside bore of the bobbin, a first inside bore adapted to accept the return spring and a second inside bore adapted to guide the actuator rod; and a washer for separating the bobbin and permanent magnet, wherein the washer rests on the flange of the bobbin.

* * * * *